US010159290B2

(12) United States Patent
Fowler

(10) Patent No.: US 10,159,290 B2
(45) Date of Patent: Dec. 25, 2018

(54) OUTWEAR WITH BODY MAPPING

(71) Applicant: Browning, Morgan, UT (US)

(72) Inventor: Misty Christina Fowler, Stansbury Park, UT (US)

(73) Assignee: BROWNING, Morgan, UT (US)

( * ) Notice: Subject to any disclaimer, the term of this patent is extended or adjusted under 35 U.S.C. 154(b) by 242 days.

(21) Appl. No.: 15/237,359

(22) Filed: Aug. 15, 2016

(65) Prior Publication Data

US 2018/0042319 A1 Feb. 15, 2018

(51) Int. Cl.

| | |
|---|---|
| ***A41D 1/04*** | (2006.01) |
| ***A41D 3/00*** | (2006.01) |
| ***A42B 1/04*** | (2006.01) |
| *A41D 31/00* | (2006.01) |

(52) U.S. Cl.

CPC ..... *A41D 3/00* (2013.01); *A42B 1/048* (2013.01); *A41D 31/0033* (2013.01); *A41D 2200/20* (2013.01); *A41D 2400/10* (2013.01)

(58) Field of Classification Search

CPC . A41D 13/02; A41D 1/04; A41D 3/00; A62B 17/003; A41B 1/00

See application file for complete search history.

(56) References Cited

U.S. PATENT DOCUMENTS

| | | | | |
|---|---|---|---|---|
| 4,470,156 | A | 9/1984 | Duerbeck et al. | |
| 4,864,656 | A * | 9/1989 | Nesse | A41D 3/00 2/108 |
| 5,001,781 | A | 3/1991 | Grilliot et al. | |
| 6,185,744 | B1 | 2/2001 | Poholski | |
| 6,427,242 | B1 | 8/2002 | Bush et al. | |
| 7,028,342 | B1 * | 4/2006 | Nordstrom | A41D 1/04 2/119 |
| 7,117,539 | B1 * | 10/2006 | Baacke | A41D 1/04 2/102 |
| 7,707,658 | B2 * | 5/2010 | Culhane | A41D 1/067 2/227 |
| 7,770,234 | B2 | 8/2010 | Roux et al. | |
| 8,516,615 | B2 | 8/2013 | Di Giovanni et al. | |
| 9,668,525 | B2 * | 6/2017 | Boyle | A41D 1/06 |
| 2009/0031486 | A1 | 2/2009 | Sokolowski et al. | |
| 2009/0216305 | A1 | 8/2009 | Bonner | |
| 2011/0088135 | A1 * | 4/2011 | Snyder | A41D 15/04 2/69.5 |
| 2011/0162125 | A1 | 7/2011 | Nilforushan et al. | |
| 2013/0291278 | A1 | 11/2013 | Volpis et al. | |
| 2015/0000005 | A1 | 1/2015 | Mather | |
| 2015/0026862 | A1 | 1/2015 | Silverberg | |
| 2015/0290901 | A1 | 10/2015 | Banowit | |

* cited by examiner

*Primary Examiner* — Tajash D Patel
(74) *Attorney, Agent, or Firm* — Dorsey & Whitney LLP

(57) ABSTRACT

Outerwear, such as thermally insulated jackets and pants are disclosed. The outerwear may include insulative panels that are positioned, oriented, sized, and shaped according to a body mapping. The body mapping may indicate areas where insulative material should be reduced to improve the mobility of a wearer of the outerwear.

33 Claims, 13 Drawing Sheets

OUTWEAR WITH BODY MAPPING

TECHNICAL FIELD

The present disclosure generally relates to a clothing having insulation and specifically relates to jackets and pants having additional thermal insulation in specific areas of the garment.

BACKGROUND

Outerwear (e.g., jackets, coats, pants, etc.) allows a person to withstand colder temperatures without discomfort or medical problems. When environmental temperatures get too high or low, the human body may not function properly. For example, if a human is in a cold environment for too long a period of time, the core temperature of the human's body may decrease and hypothermia may set in. To withstand lower temperatures, humans developed insulated outerwear to maintain core body temperatures in lower environmental temperatures.

Insulated outerwear, however, may be thick and bulky. Consequently, the bulk of the insulated outerwear may restrict the movement of the wearer. Such restrictions of movement may impede a person during an activity. For example, while tracking an animal during the winter, a hunter may not want a bulky winter coat because it will make travelling quietly more difficult. Accordingly, there is a need for improvements to insulated outerwear to provide more freedom of movement to a wearer.

SUMMARY

One aspect of the present disclosure relates to a jacket having insulation. The jacket may include a collar, a vest, a front insulative panel, and a back insulative panel. The vest may extend from the collar to a hem. The vest may be made of a first material. The vest may include a front vest panel positioned on an anterior-side of the vest and a back vest panel positioned on a posterior-side of the vest. The front insulative panel may be positioned on the front vest panel extending from a first seam to a first edge. The back insulative panel may be positioned on the back vest panel extending from a second seam to a second edge. The front insulative panel and the back insulative panel are separated by a first span at an armpit of the vest, and the front insulative panel and the back insulative panel may be separated by a second span at the first edge. The second span may be greater than the first span.

In some embodiments, a side seam may connect the front vest panel and the back vest panel, the side seam may extend between the armpit of the vest and the hem, a first front span may be defined between the front insulative panel and the side seam at the armpit, and a second front span may be defined between the front insulative panel and the side seam at the first edge. The second front span may be greater than the first front span. In some embodiments, a first back span may be defined between the back insulative panel and the side seam at the armpit. A second back span may be defined between the back insulative panel and the side seam at the first edge. The second back span may be greater than the first back span. In some embodiments, a third back span may be defined between the back insulative panel and the side seam at the second edge. The third back span may be greater than the second back span.

In some embodiments, the front vest panel may define a front panel length between the collar and the hem. The front insulative panel may define a front insulation length between the collar and the first edge. The front panel length may be greater than the front insulation length. In some embodiments, a front insulation length may be defined between the collar and the first edge. A back insulation length may be defined between the collar and the second edge. The back insulation length may be greater than the front insulation length. In some embodiments, the back vest panel may defines a back panel length. The back panel length may be greater than the back insulation length.

In some embodiments, a first back panel span may be defined between the second edge and the hem at a first end of the second edge. A second back panel span may be defined between the second edge and the hem at a mid-point of the second edge between the first end and a second end of the second edge. The second back panel span may be greater than the first back panel span. In some embodiments, the back vest panel includes a yoke and the back insulative panel may be positioned at least partially on the yoke. In some embodiments, a front height positioned at the anterior-side of the collar may be less than a height of the collar. In some embodiments, a hood may extend from the collar to a brim, the hood may be made of the first material. A hood insulative panel may extend from the collar to the brim, the hood insulative panel may define an insulation width that is less than a hood width.

In some embodiments, a sleeve may extend from an armscye of the vest to a cuff, the sleeve may be made of the first material. A first sleeve insulative panel may be positioned on the sleeve and may extend from the armscye to a first elbow edge. A second sleeve insulative panel may be positioned on the sleeve and may extend from a second elbow edge to the cuff. In some embodiments, the first elbow edge and the second elbow edge may be separated by a sleeve distance. In some embodiments, the first sleeve insulative panel and the second sleeve insulative panel may be positioned opposite a sleeve seam of the sleeve. In some embodiments, both the first sleeve insulative panel and the second sleeve insulative panel may define widths that are less than a diameter of the sleeve.

In some embodiments, the front insulative panel and the back insulative panel may be made of a second material different from the first material. In some embodiments, the first material may be fleece and the second material may be a synthetic microfiber thermal insulation. In some embodiments, the synthetic microfiber thermal insulation may be Primaloft. In some embodiments, the back insulative panel may include more of the second material per square meter than the front insulative panel. In some embodiments, the back insulative panel may comprise 80 grams per square meter of the second material and the front insulative panel may comprise 60 grams per square meter of the second material.

In some embodiments, the front insulative panel and the back insulative panel may be positioned on an inner surface of the vest such that the front insulative panel and the back insulative panel may face a body of a wearer of the jacket. In some embodiments, a front liner may be coupled to the front vest panel of the vest. The front liner may be made of a third material different than the first material. A back liner may be coupled to the back vest panel of the vest. The back liner may be made of the third material. The front insulative panel may be positioned between the front liner and the vest and the back insulative panel may be positioned between the back liner and the vest.

Another aspect of the disclosure relates to pants having insulation. The pants may include a waistband, a first leg, a front insulative panel, and a back insulative panel. The first leg may extend from the waistband to a hem defining a first length. The first leg may be made of a first material. The front insulative panel may be positioned on an anterior-side of the first leg. The front insulative panel may extend from the waistband and may terminate before the hem. The front insulative panel may define a second length. The second length may be less than the first length. The back insulative panel may be positioned on a posterior-side of the first leg. The back insulative panel may extend from the waistband and may terminate before the hem. The back insulative panel may define a third length. The third length may be less than the second length.

In some embodiments, the first leg may further include an interior panel extending from a crotch of the first leg to the hem. The interior panel may be made of the first material. In some embodiments, the front insulative panel and the back insulative panel may be positioned on an inner surface of the first leg such that the front insulative panel and the back insulative panel are facing a body of a wearer of the pant. In some embodiments, the front insulative panel may define a first inseam length between a crotch an end of the front insulative panel and the back insulative panel may define a second inseam length between the crotch and an end of the back insulative panel. The second inseam length may be less than the first inseam length. In some embodiments, as a size of the pant changes, the first inseam length and the second inseam length do not change. In some embodiments, the front insulative panel and the back insulative panel may be made of a second material different from the first material. In some embodiments, the first material may be fleece and the second material may be a synthetic microfiber thermal insulation. In some embodiments, the synthetic microfiber thermal insulation may be Primaloft.

In some embodiments, a front liner may be coupled to the anterior-side of the first leg. The front liner may be made of a third material different than the first material. A back liner may be coupled to the posterior-side of the first leg. The back liner may be made of the third material. The front insulative panel may be positioned between the front liner and the first leg and the back insulative panel may be positioned between the back liner and the first leg. In some embodiments, the front insulation panel may terminate at a knee of a wearer of the pant. In some embodiments, the back insulative panel may terminate at a mid-thigh of a wearer of the pant.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1B:
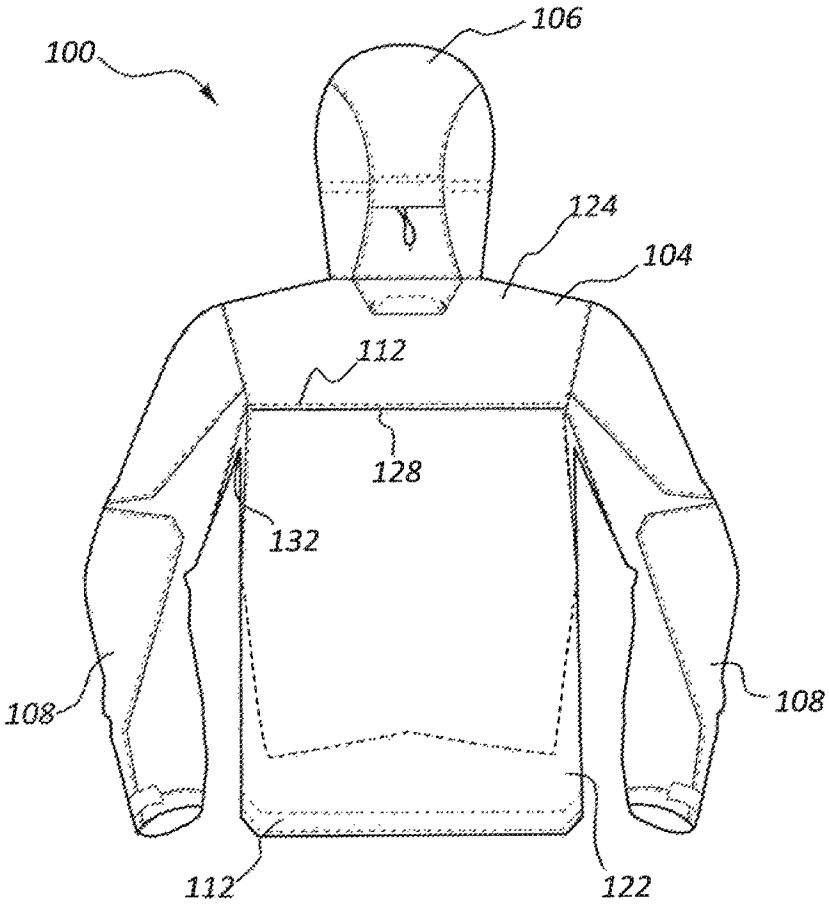
FIG. 1B is a back elevation view of the jacket of FIG. 1A according to an embodiment of the disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure generally relates to insulated outer clothing, such as jackets and pants, that are configured to provide protection from a lower environmental temperatures via thermal insulation while maintaining the mobility of the wearer. The outerwear may include an outer layer defining a collar, a vest, and sleeves. The outerwear may also include insulative thermal panels positioned on the outer layer according to a body mapping. The body mapping of the insulative thermal panels may be based at least in part on performance requirements of a wearer of the garment. For example, an insulative thermal panel may be positioned adjacent the garment's outer shoulder while the armpit of the garment has no such insulative panel. In this manner, outerwear may provide thermal insulation from environment temperatures while minimizing restrictions of movement imposed on the wearer by not including an insulative layer in the armpit region. As is discussed herein, other mappings of insulative panels are also contemplated by this disclosure.

As used herein, terms of anatomical location (e.g., anterior, posterior, proximal, distal, medial, lateral, etc.) may be used to describe relative positions of portions of the outerwear. Such use of terms of anatomical location refer to positions of the outerwear as designed in relation to the body of the wearer.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, features described with respect to certain embodiments may be combined in other embodiments.

Figure 1A:
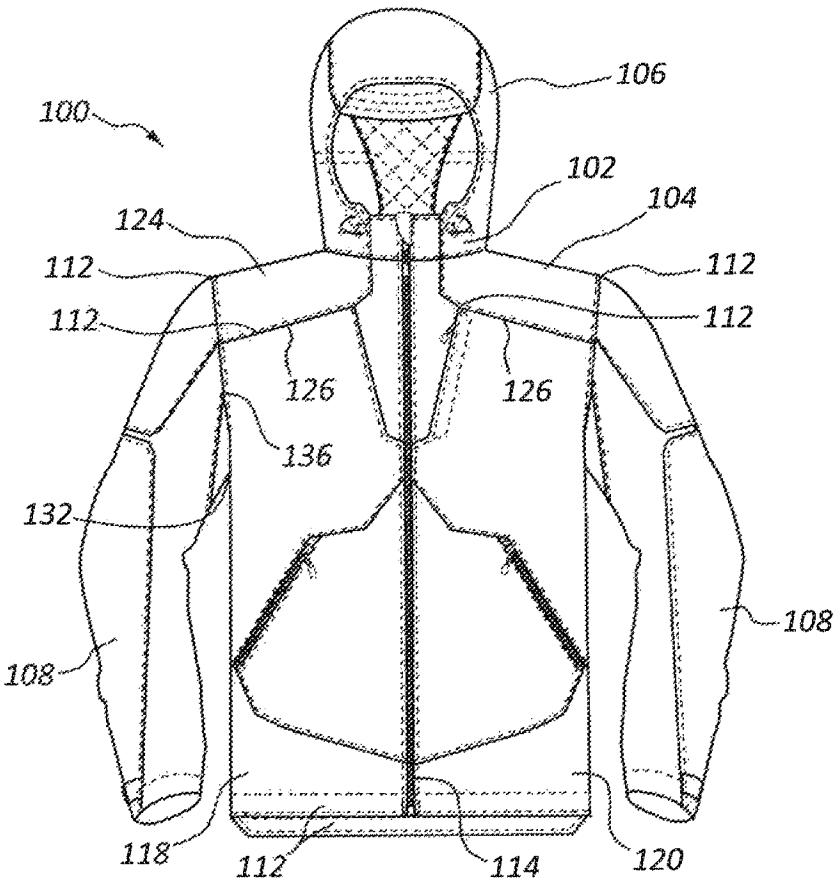
FIG. 1A is a front elevation view of a jacket according to an embodiment of the disclosure.

FIGS. 1A-1B show a jacket 100 according to an embodiment of the disclosure. The jacket 100 may include a collar 102, a vest 104, a hood 106, and a sleeves 108. The collar 102, vest 104, and sleeves 108 may be coupled together via one or more seams 110. The vest 104 may extend from the collar 102 to a hem 112 of the vest 104. The vest 104 may be sized to receive a torso of a wearer of the jacket 100. An anterior-side of the vest 104 may be split and configured to allow a wearer to put on or take off the jacket 100. A fastener 114 may be positioned at the split of the vest 104 to allow the wearer of the jacket 100 to selectively couple the portions of the vest 104 together. The fastener 114 may include a zipper, buttons, hook-and-loop fasteners, or any other type of attachment device. In some embodiments, the hood 106 is selectively coupled to collar 102 or vest 104 of the jacket 100 via a fastener, such as a zipper, hook-and-loop fasteners, or buttons.

Figure 2B:
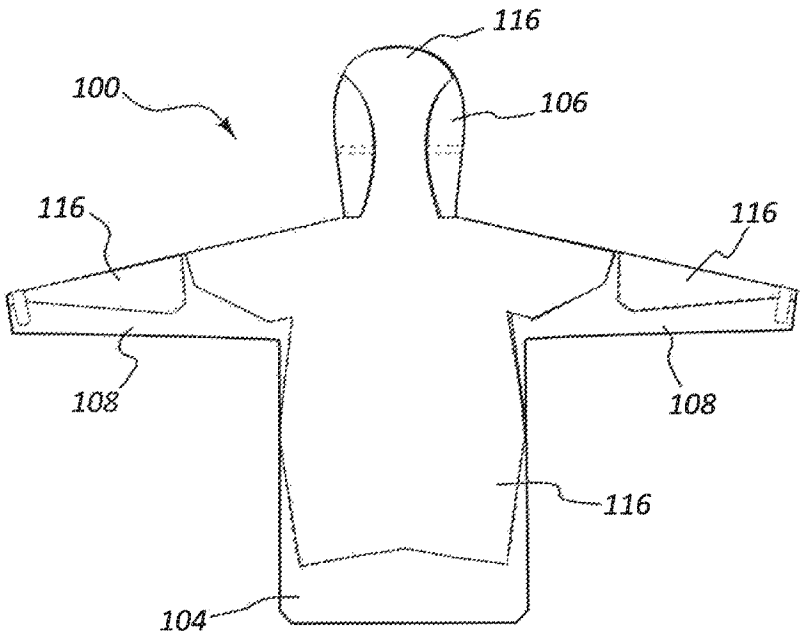
FIG. 2B is a back elevation view of the jacket of FIG. 1A showing a body mapping of insulative material according to an embodiment of the disclosure.
Figure 2A:
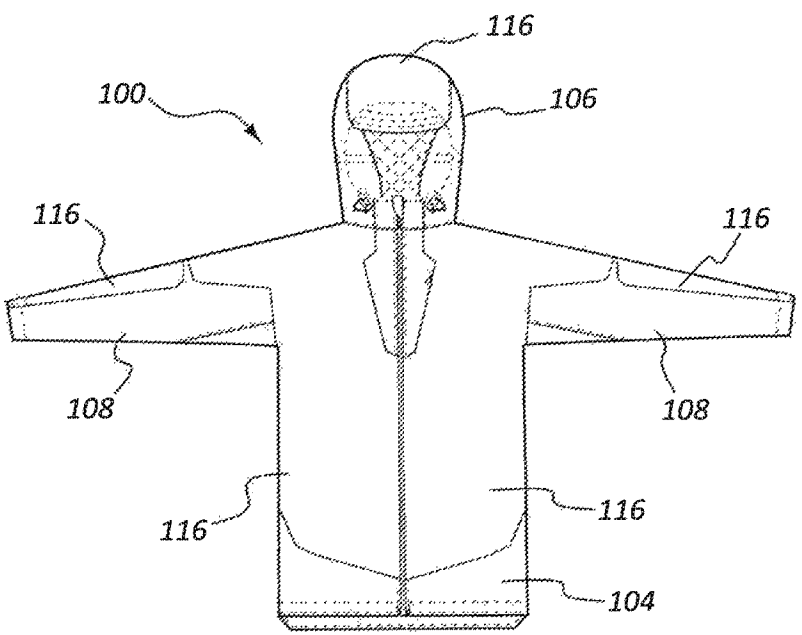
FIG. 2A is a front elevation view of the jacket of FIG. 1A showing a body mapping of insulative material according to an embodiment of the disclosure.

FIGS. 2A-2B shows insulative panels 116 that may be positioned on the jacket 100. The positions, orientations, shapes, and sizes of the insulative panels 116 may be based at least in part on a body mapping. The body mapping may indicate portions of the jacket 100 likely to be restrict movement of a wearer of the jacket 100 and portions of the jacket 100 suited to provide thermal insulation to the wearer. The body mapping may be determined based at least in part on the mobility needs of the wearer and the thermal insulation needs of the wearer. The body mapping may be configured to reduce restriction in mobility of a wearer caused by some insulative garments while still providing thermal insulation to the wearer. In some examples, the insulative panels 116 may be referred to as insulative layers or layers of insulative material.

Returning to FIGS. 1A-1B, the vest 104 includes a first front vest panel 118, a second front vest panel 120, a back vest panel 122, and a yoke 124. The front vest panels 118, 120 may be positioned on an anterior-side of the vest 104 (see FIG. 1A) and the back vest panel 122 may be positioned on a posterior-side of the vest 104 (see FIG. 1B). The yoke 124 may be defined as the area under the collar 102 that drapes over the shoulder of the wearer and holds the back vest panel 122 over the wearer's body. The yoke 124 may be coupled to the front vest panels 118, 120 via seams 126. In the illustrative embodiment, the seams 126 are positioned adjacent to the breast of the wearer of the jacket 100. In other examples, the seams 126 may be positioned at the tops of the shoulders of the wearer of the jacket 100, such that the seams 126 may be considered shoulder seams. The yoke 124 may be coupled to the back vest panel 122 via a seam 128. In some examples and throughout this disclosure, the yoke 124 may be considered part of the back vest panel 122 and descriptions of the back vest panel 122 may include portions that may more properly belong to the yoke 124.

Figure 3:
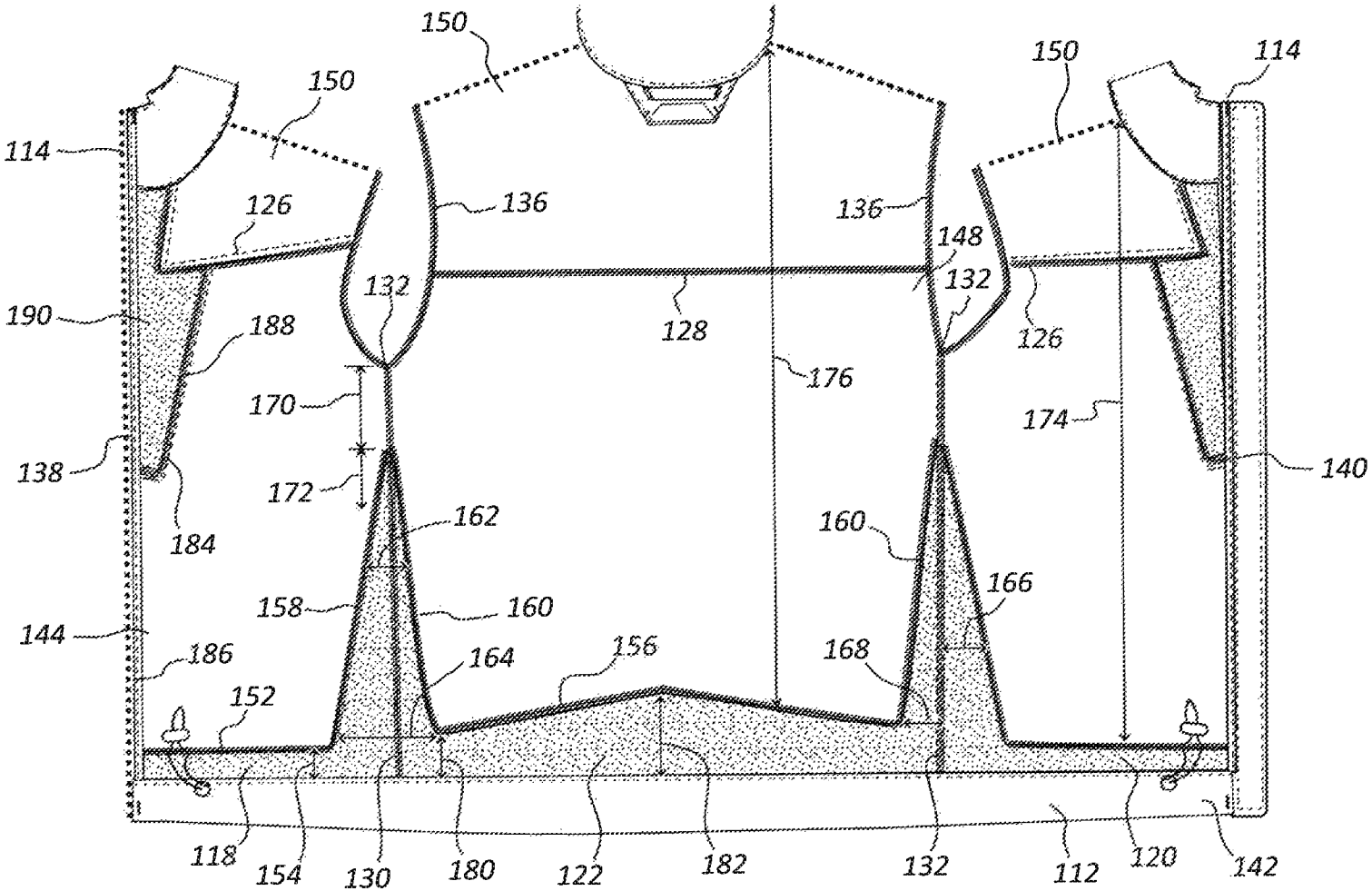
FIG. 3 shows an elevation view of a vest of the jacket of FIG. 1A according to an embodiment of the disclosure.

FIG. 3 shows an elevation view of the vest 104 according to an embodiment of the disclosure. In FIG. 3, the vest 104 is flattened to show the construction of the vest 104. The first front vest panel 118 may be coupled to back vest panel 122 via a first side seam 130 extending from an armpit 132 to the hem 112 of the jacket 100. The second front vest panel 120 may be coupled to back vest panel 122 via a second side seam 134 extending from an armpit 132 to the hem 112 of the jacket 100. Because the front vest panels 118, 120 are generally symmetrical, the disclosure will only discuss in detail the first front vest panel 118. However, it should be understood, that the descriptions of the first front vest panel 118 also apply to the second front vest panel 120.

The front vest panels 118, 120 and the back vest panel 122 may cooperate to form an armscye 136 of the jacket 100. An armscye 136 may be the fabric edge that defines an armhole of a garment. The sleeves 108 may be coupled to the vest 104 at the armscye 136 via seams 333. The length of the armscye 136 may be the total length the fabric edge. The armpit 132 of the vest 104 may be positioned on the armscye 136.

The first front vest panel 118 also extends from the first side seam 130 and the armscye 136 to an anterior edge 138. A portion of the fastener 114 may be coupled to the vest 104 near the anterior edge 138. The anterior edge 138 is configured to mate with a corresponding anterior edge 140 on the second front vest panel 120.

In the illustrative embodiment of FIG. 3, the hem 112 of the jacket 100 is depicted as being a straight line. In other embodiments, however, the hem 112 of the jacket 100 may not be a straight line. Instead, the hem 112 associated with the back vest panel 122 may drop below the hem associated with the front vest panels 118, 120 such that the back vest panel 122 extends farther down a wearer's body than the front vest panels 118, 120. For example, the hem 112 may include five portions. A first portion may extend in a straight line along the first front vest panel 118 between the anterior edge 138 and the first side seam 130. The second portion may extend from the first side seam 130 along the back vest panel 122 at an angle away the collar 102. The third portion may extend along the back vest panel 122 parallel to first portion. The third portion may be offset from the first portion because of the angle of the second portion. The fourth portion may extend between the third portion and the second side seam 134 along the back vest panel 122. The fourth portion may extend at an angle such that the hem 112 moves toward the collar 102. A fifth portion may extend in a straight line along the second front vest panel 120 between the anterior edge 140 and the second side seam 134. The fifth portion may extend parallel to both the first portion and the third portion. In some embodiments, the hem 112 forms a casing 142 sized to enclose a drawstring or an elastic.

The jacket 100 also includes insulative panels 116 selectively positioned on the vest 104 according to a body mapping. In illustrative embodiment, the insulative panels 116 may include a first front insulative panel 144, a second front insulative panel 146, a back insulative panel 148, and a yoke insulative panel 150. Each of the insulative panels 144, 146, 148, 150 may correspond to a similarly named panels (e.g., panels 118, 120, 122, 124) of the jacket 100. In some embodiments, the insulative panels 116 of the vest 104 may be considered a single insulative panel.

The first front insulative panel 144 may extend from the seam 126 to a first bottom edge 152 positioned near the hem 112 associated with the first front vest panel 118. A front bottom span 154 being defined between the hem 112 and the first bottom edge 152. The back insulative panel 148 may extend from the seam 128 to a second bottom edge 156 positioned near the hem 112 associated with the back vest panel 122.

The first front insulative panel 144 may include a front lateral edge 158 extending between the armscye 136 and the first bottom edge 152. The back insulative panel 148 may include a back lateral edge 160 extending between the armscye 136 and the second bottom edge 156. The front lateral edge 158 and the back lateral edge 160 are positioned near the side seams 130, 134. For example, the front lateral edge 158 and the back lateral edge 160 may be positioned near the first side seam 130.

At a first point along the first side seam 130, the front lateral edge 158 and the back lateral edge 160 may be separated by a first span 162. The first span 162 defining a distance between the two lateral edges 158, 160. At a second point along the first side seam 130, the front lateral edge 158 and the back lateral edge 160 may be separated by a second span 164 different than the first span 162. The second span 164 may define a distance between the two lateral edges 158, 160. In some embodiments, the second point may be closer to the hem 112 than the first point and the second span 164 may be larger than the first span 162. In the illustrative example, as the lateral edges 158, 160 get closer to the hem 112 the distance between the lateral edges 158, 160 gets larger.

In addition, a number of front spans 166 may be defined between the first side seam 130 and the front lateral edge 158 and a number of back spans 168 may be defined between the first side seam 130 and the back lateral edge 160. In such examples, either the first span 162 or the second span 164 may comprise a combination of a front span 166 and a back span 168. In some embodiments, the distance defined by the front span 166 and the distance defined by the back span 168 of a total span (e.g., spans 162, 164) may not be equal. Meaning, either the distance of the front span 166 may be greater than or less than the distance of the back span 168 defined in a total span. In some embodiments, the back span 168 positioned at the second bottom edge 156 may be equal to two inches.

The spans 162, 164 may vary along the length of the first side seam 130. For example, along a first superior-inferior distance 170 of the first side seam 130, the span between the lateral edges 158, 160 may be equal to zero. Along a second superior-inferior distance 172 of the first side seam 130, the span between the lateral edges 158, 160 is greater than zero. In some embodiments, the first superior-inferior distance 170 may be equal to two inches. In other embodiments, the first superior-inferior distance 170 may be a small distance because the two lateral edges 158, 160 meet near the armpit 132. It should be appreciated that front spans, back spans, and total spans may be defined at any point along the side seams 130, 134.

A front insulation length 174 may be defined between the collar 102 and the first bottom edge 152. A back insulation length 176 may be defined between the collar 102 and the second bottom edge 156. In some embodiments, the back insulation length 176 is greater than the front insulation length 174.

The front bottom span 154 may be defined between the hem 112 and the first bottom edge 152. As used in this disclosure, a span may define a distance between two or more objects. A first back bottom span 180 may be defined between the hem 112 and the second bottom edge 156 at the back lateral edge 160. In some embodiments, the front bottom span 154 is greater than the first back bottom span 180. In some embodiments, the front bottom span 154 is less than the first back bottom span 180. A second back bottom span 182 may be defined between the hem 112 and the second bottom edge 156 at a point between the back lateral edges 160 of the back insulative panel 148. In some embodiments, the second back bottom span 182 is greater than the first back bottom span 180. In this manner, the back insulative panel 148 may be raised near the spine of the wearer so as to not impede movement of the lower back of the wearer. In some embodiments, the first back bottom span 180 may be equal to two and one-half inches. In some embodiments, the second back bottom span 182 may be equal to five inches.

The first front insulative panel 144 may also include an anterior edge 184 extending between the collar 102 and the first bottom edge 152. Along a first portion 186, the anterior edge 184 travels along the anterior edge 138 of the first front vest panel 118. Along a second portion 188, the anterior edge 184 diverges from the anterior edge 138 to create an area 190 free of insulation near the fastener 114. The area 190 free from insulation may prevent the jacket 100 from bunching around the wearer's chin thereby increasing the mobility of the wearer.

In some embodiments, the back vest panel 122 may include the yoke 124. In addition, the back insulative panel may be positioned at least partially on the yoke 124. In other embodiments, the yoke 124 includes the yoke insulative panel 150.

Figure 4:
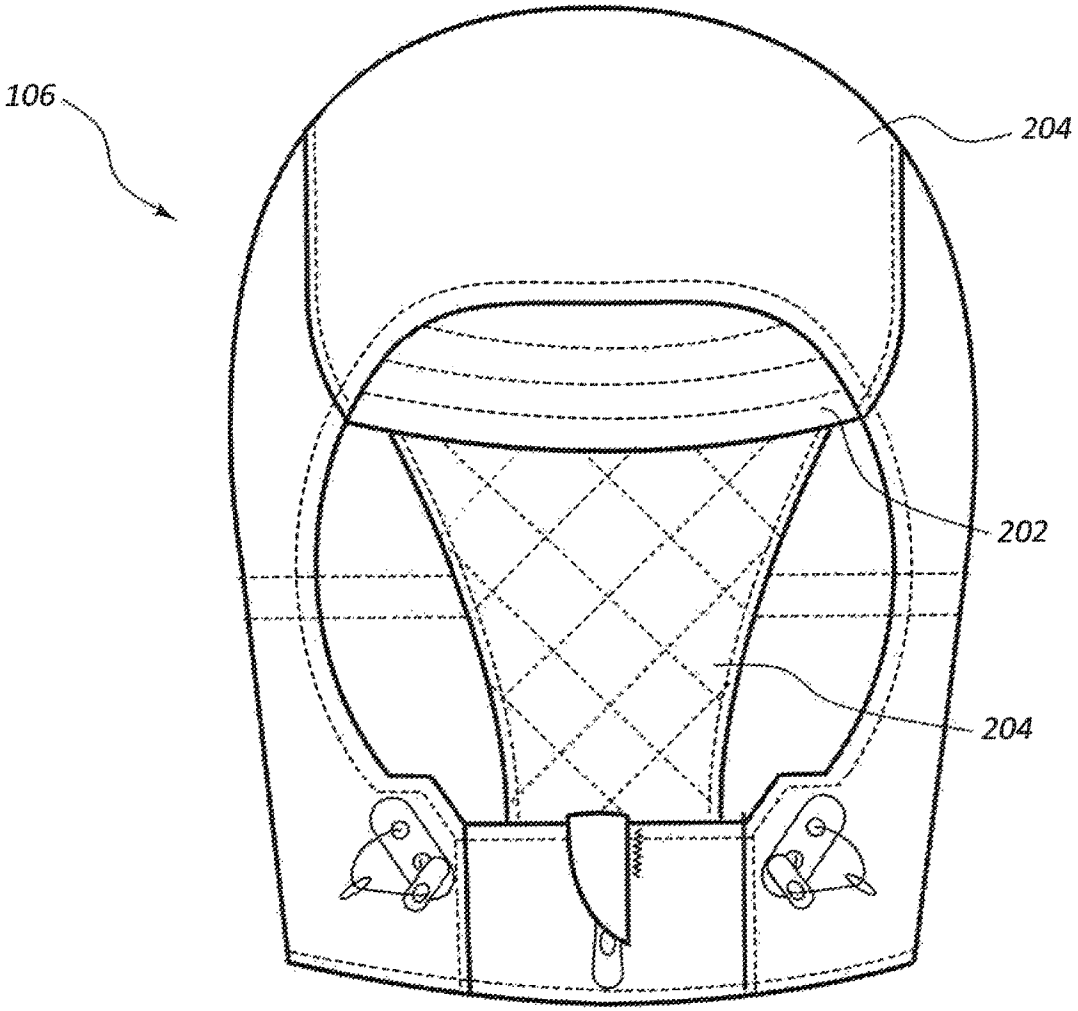
FIG. 4 is an elevation view of a hood of the jacket of FIG. 1A according to an embodiment of the disclosure.

FIG. 4 shows an elevation view of the hood 106 according to an embodiment of the disclosure. The hood 106 is sized to form around the head of the wearer of the jacket 100. The hood 106 may be selectively coupled to the collar 102 of the vest 104 of the jacket 100 via a fastener of some type. In some embodiments, the fastener may be a zipper, buttons, or hook-and-loop fasteners. The hood 106 may include a brim 202 projecting above a hole created by the hood 106. A hood insulative panel 204 may be positioned along the length of the hood 106 between the brim 202 and the fastener of the hood 106. The hood insulative panel 204 may not cover all of the hood 106. In the illustrative embodiment, the hood insulative panel 204 is configured to insulate the back and top of the wearer's head but not the sides of the head. In other embodiments, however, other sizes, shapes, positions, and/or orientations of the hood insulative panel 204 are contemplated.

Figure 5A:
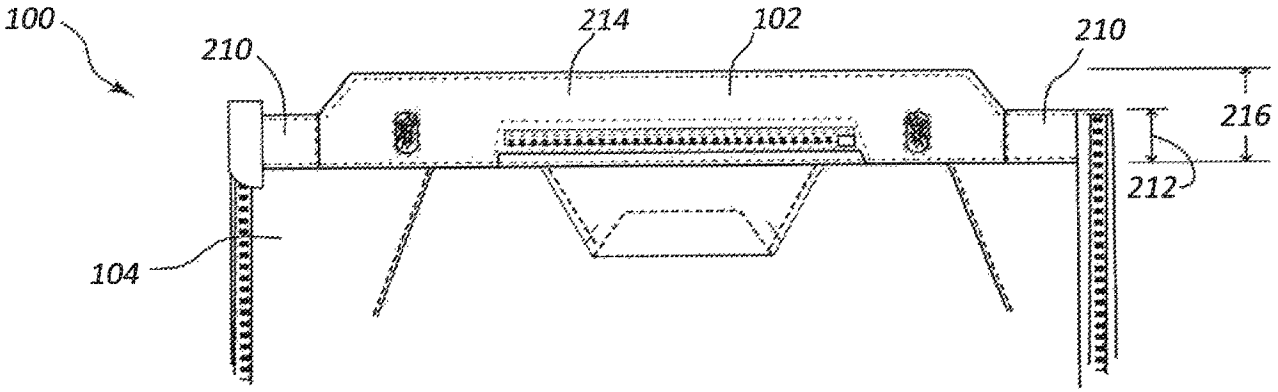
FIG. 5A is an elevation view of a collar of the jacket of FIG. 1A according to an embodiment of the disclosure.
Figure 5B:
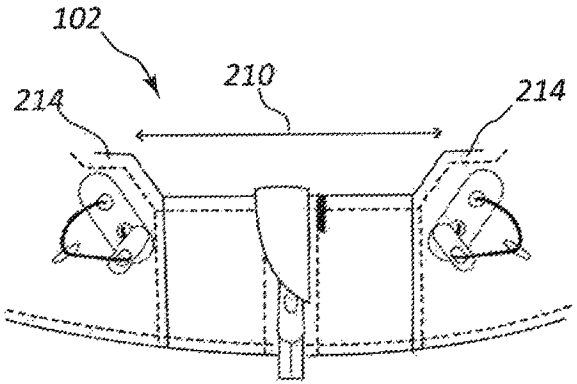
FIG. 5B is an elevation view of the collar of the jacket of FIG. 1A according to an embodiment of the disclosure.

FIGS. 5A-5B shows an elevation view of the collar 102 according to an embodiment of the disclosure. The collar 102 extends from the vest 104 and is configured to surround a neck of the wearer of the jacket 100. Along an anterior portion 210, the collar 102 defines a front height 212. Along a posterior portion 214, the collar 102 defines a height 216 that is greater than the front height 212 of the collar 102. In some embodiments, the height 216 is one inch greater than the front height 212 of the collar 102.

Figure 6B:
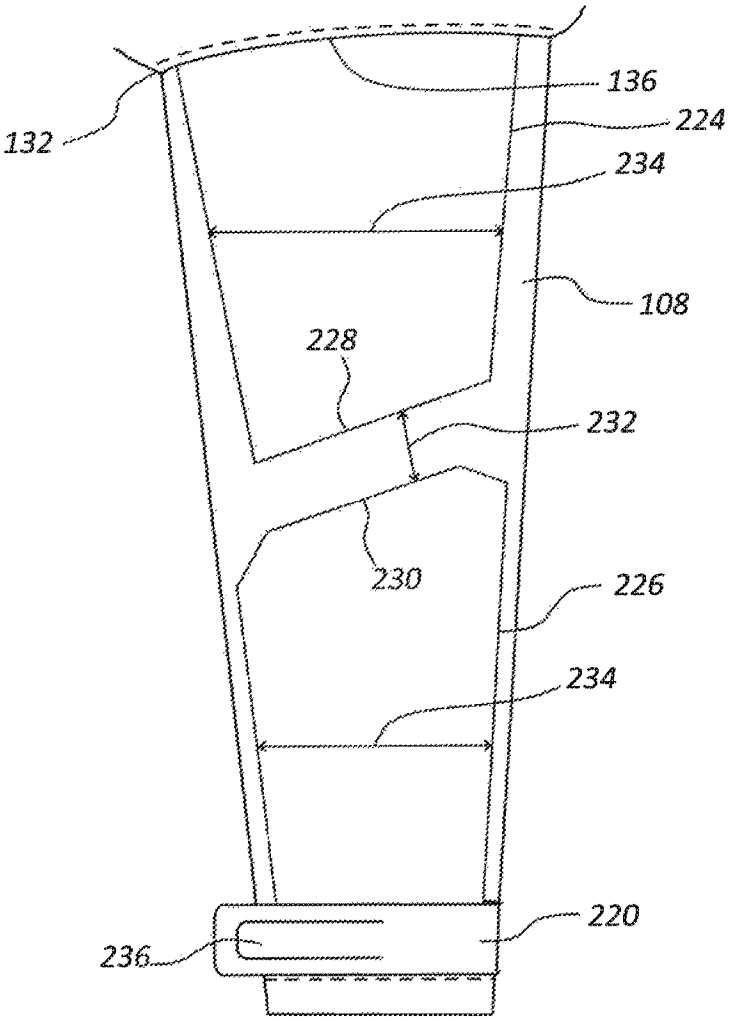
FIG. 6B is a top plan view of the sleeve of the jacket of FIG. 1A according to an embodiment of the disclosure.
Figure 6A:
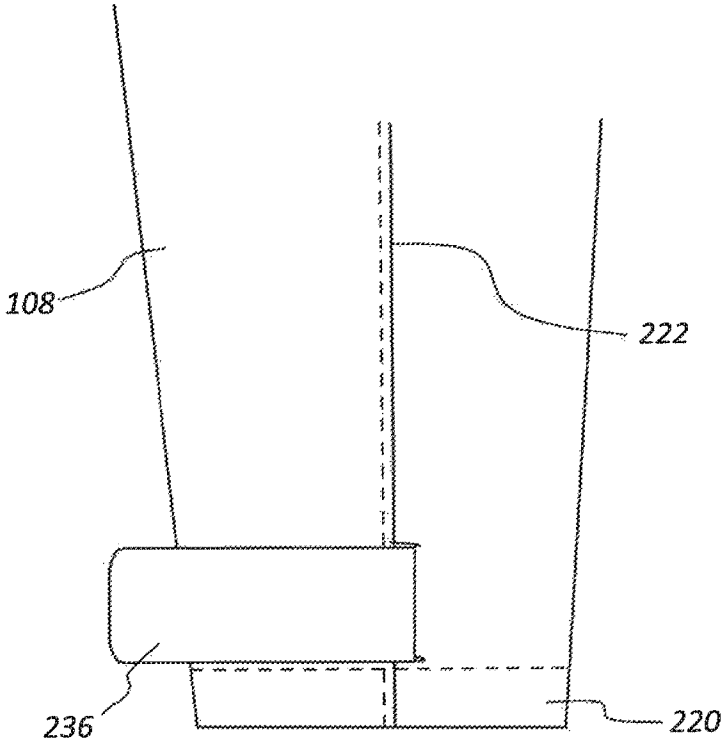
FIG. 6A is a bottom plan view of a sleeve of the jacket of FIG. 1A according to an embodiment of the disclosure.

FIGS. 6A-6B show various aspects of the sleeves 108 according to an embodiment of the disclosure. For ease of description, the features of only one sleeve 108 will be described. However, it should be appreciated that the sleeves 108 are similarly embodied. The sleeve 108 extends from vest 104 at the armscye 136 to a cuff 220. A sleeve seam 222 extends from the armpit 132 of the armscye 136 to the cuff 220 along one side of the sleeve 108. In some embodiments, the sleeve seam 222 extends down the side of the sleeve that is closest to the body of the wearer of the jacket 100.

The sleeve 108 includes a proximal insulative panel 224 and a distal insulative panel 226. The proximal insulative panel 224 extends from the armscye 136 to a first elbow edge 228. The distal insulative panel 226 extends from a second elbow edge 230 to the cuff 220. The insulative panels 224, 226 are positioned on the top of the sleeve opposite the sleeve seam 222. The first elbow edge 228 and the second elbow edge 230 are separated by a distance 232. Both the proximal insulative panel 224 and the distal insulative panel 226 define widths 234 that are less than the diameter of the sleeve 108. The distance 232 and the widths 234 are configured to allow the wearer to have mobility at the elbow without being impeded by additional thermal insulation. The sleeve 108 may also include a fastener 236 used to alter the diameter of the cuff 220, such as hook-and-loop fasteners. In the illustrative embodiments of this disclosure, the insulative panels 144, 146, 148, 150, 204, 224, 226 are coupled to an inner surface of the jacket 100 such that the insulative panels 144, 146, 148, 150, 204, 224, 226 are positioned between an outer layer 250 of the jacket 100 and the body of the wearer.

Figure 7:
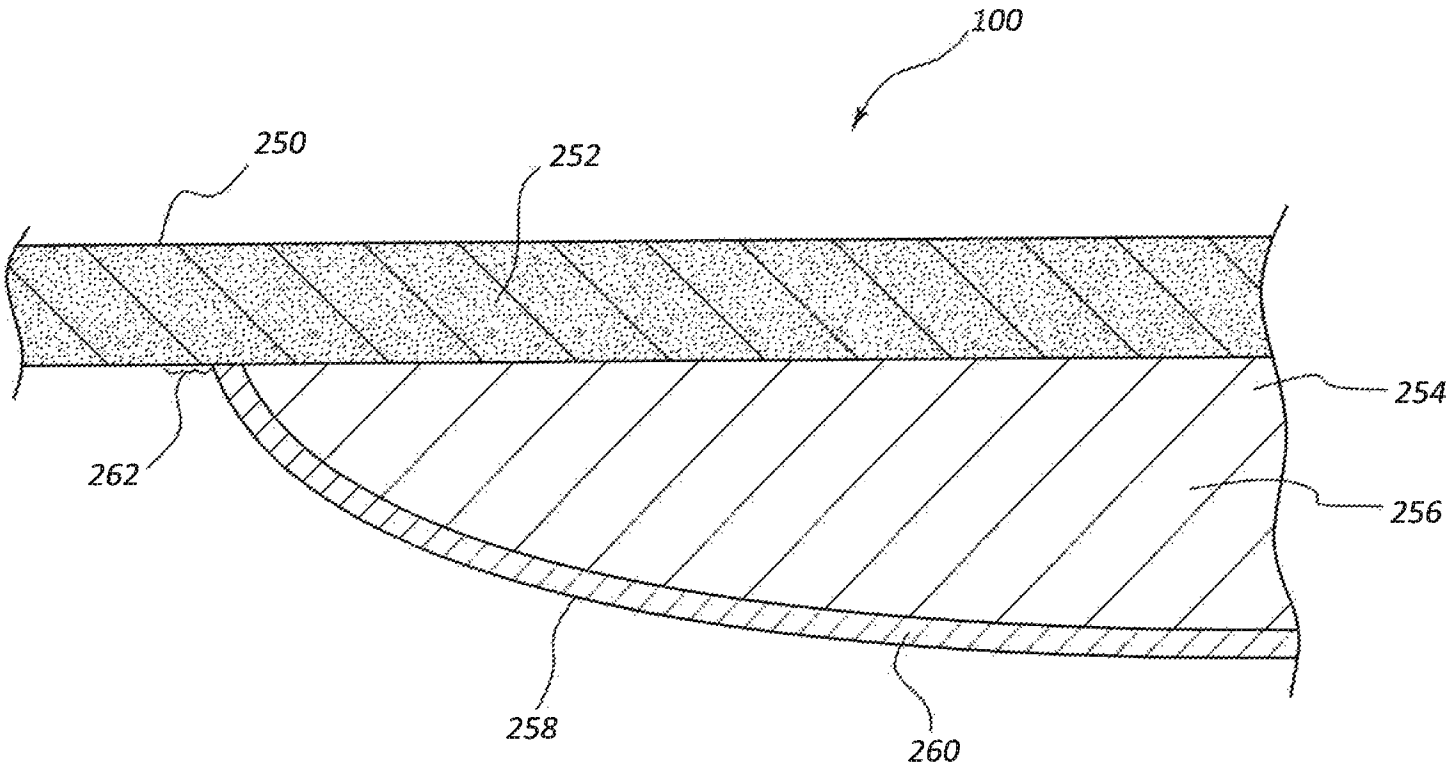
FIG. 7 is a cross-sectional view of the jacket of FIG. 1A taken along line 7-7 according to an embodiment of the disclosure.

FIG. 7 shows a cross-section of the jacket 100 according to an embodiment of the disclosure. The jacket 100 may include an outer layer 250 made from a first material 252, an insulative layer 254 made from a second material 256, and a liner 258 made from a third material 260. The insulative panels described above (e.g., insulative panels 144, 146, 148, 150, 204, 224, 226) may be embodied as the insulative layer 254 made from the second material 256. The remaining portions of the jacket 100 (e.g., the collar 102, vest 104, hood 106, sleeves 108) may be embodied as the outer layer 250 made from the first material 252. The liner 258 is coupled to the inner surface of the jacket 100 and is positioned to secure the insulative layer 254 to the jacket 100. For example, the first front insulative panel 144 may be positioned between a liner 258 and an inner surface of the first front vest panel 118. The liner 258 may be secured to the outer layer 250 via one or more seams 262.

The first material 252 may be different than the second material 256 or the third material 260. In some embodiments, the first material 252 is fleece. In some embodiments, the second material is a synthetic microfiber thermal insulation. In some embodiments, the second material is sold under the trademark Primaloft®. In some embodiments, the third material is a synthetic material. In some embodiments, the third material is taffeta.

In some embodiments, different insulative panels 144, 146, 148, 150, 204, 224, 226 may include different amounts or densities of the second material. For example, amounts of the second material may be measure grams per square meter. For example, the back insulative panel 148 may include more of the second material than other insulative panels (e.g., insulative panels 144, 146).

In some embodiments, the outer layer 250 may comprise a three-layer bonded fabric. The three-layer bonded fabric may be wind and water resistant. The three-layer bonded fabric may include a quiet outer shell, a wind resistant membrane, and a fleece inner lining.

Figures 8A, 8B, 8C:
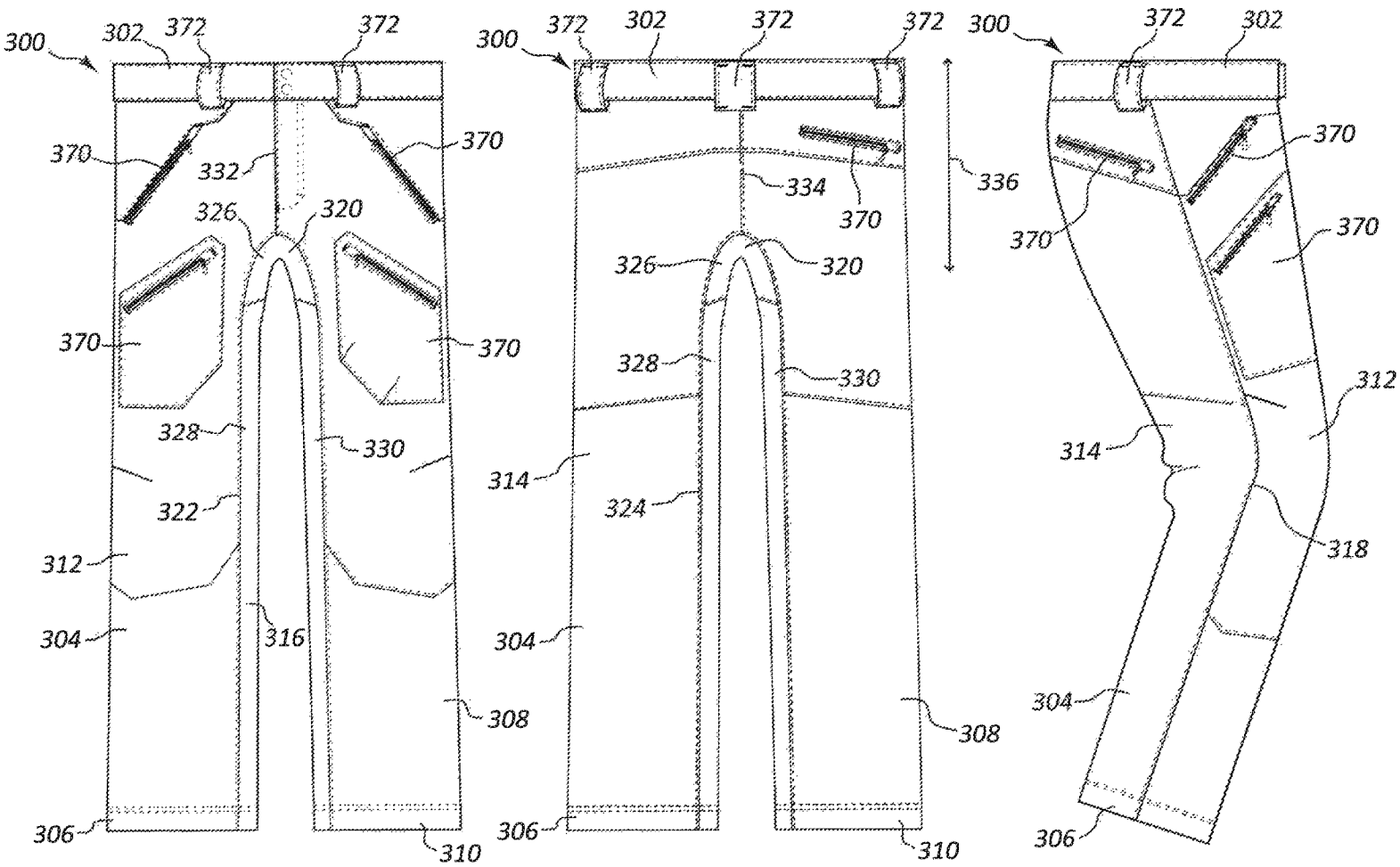
FIG. 8A is a front elevation view of pants according to an embodiment of the disclosure.
FIG. 8B is a back elevation view of the pants of FIG. 8A according to an embodiment of the disclosure.
FIG. 8C is a side elevation view of the pants of FIG. 8A according to an embodiment of the disclosure.

FIGS. 8A-8C shows pants 300 according to an embodiment of the disclosure. The pants 300 include insulation that is shaped, sized, positioned, and oriented on pants according to a body mapping. The body mapping may be determined by balancing considerations of reducing heat loss of a wearer and the wearer's mobility while wearing the pants. The pants 300 may be constructed in a similar manner as the jacket 100 and what is described in relation to FIG. 7. For example, the pants 300 may have an outer layer 250 made of the first material 252, an insulative layer 254 made of the second material 256, and a liner 258 made of the third material 260.

The pants 300 may include a waistband 302, a first leg 304 extending from the waistband to a first hem 306, and a second leg 308 extending from the waistband to a second hem 310. In this disclosure, generally only the features of the first leg 304 are described. The second leg 308 is similarly embodied as the first leg 304, and, as such, the descriptions of the first leg 304 also apply to the second leg 308.

The leg 304 includes a front leg panel 312, a back leg panel 314, and an interior panel 316. The front leg panel 312 may be positioned on the anterior-side of the pants (see FIG. 11A) and extend between the waistband 302 and the hem 306. The back leg panel 314 may be positioned on the posterior-side of the pants (see FIG. 11B) and extend between the waistband 302 and the hem 306. The front leg panel 312 may be coupled to the back leg panel 314 via a side seam 318 that extends from the waistband 302 to the hem 306. The side seam 318 is positioned on the lateral-side of the leg 304 (see FIG. 8C).

The interior panel 316 extends from a crotch 320 to the hem 306. The interior panel 316 is positioned on the medial-side of the leg 304 opposite the side seam 318. The interior panel 316 may be coupled to the front leg panel 312 via an anterior inseam 322 and may be coupled to the back leg panel 314 via a posterior inseam 324. In some embodiments, the interior panel 316 includes a crotch panel 326, a first leg panel 328, and a second leg panel 330. In some embodiments, the interior panel 316 may be made of the first material.

In the construction of the pants 300, the first leg 304 may be coupled to second leg 308 via an anterior crotch seam 332 and a posterior crotch seam 334. The anterior crotch seam 332 may extend from the waistband 302 to the crotch 320 on the anterior-side of the pants 300, and may terminate at the anterior inseam 322. The posterior crotch seam 334 may extend from the waistband 302 to the crotch 320 on the posterior-side of the pants 300, and may terminate at the posterior inseam 324. The pants 300 may also define a rise 336 measured from the top of the waistband 302 to the crotch 320.

Figure 9B:
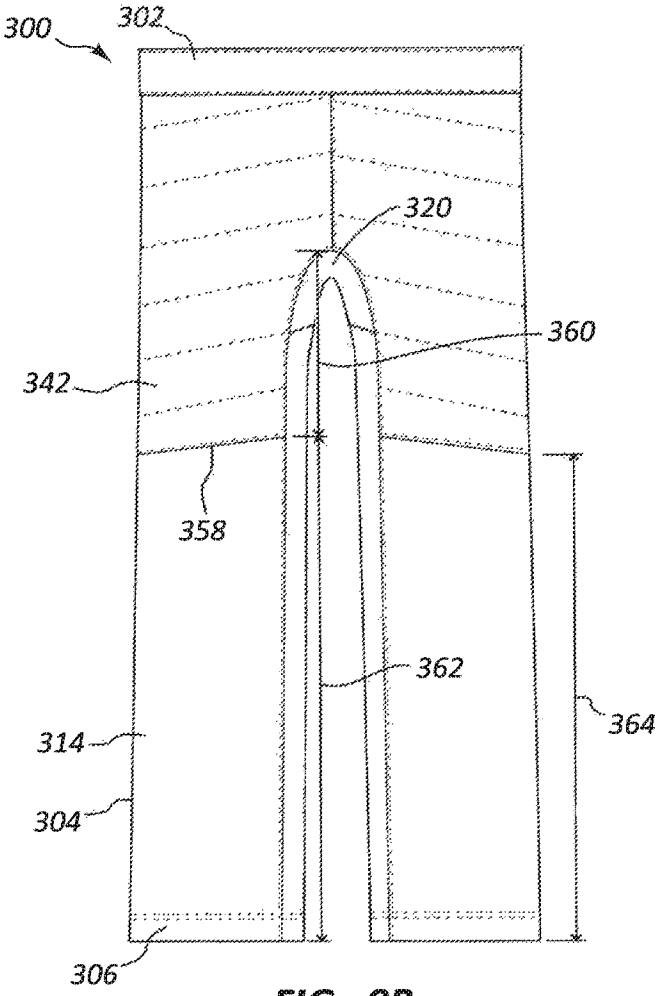
FIG. 9B is a back elevation view of the pants of FIG. 8A showing a body mapping of insulative material according to an embodiment of the disclosure.
Figure 9A:
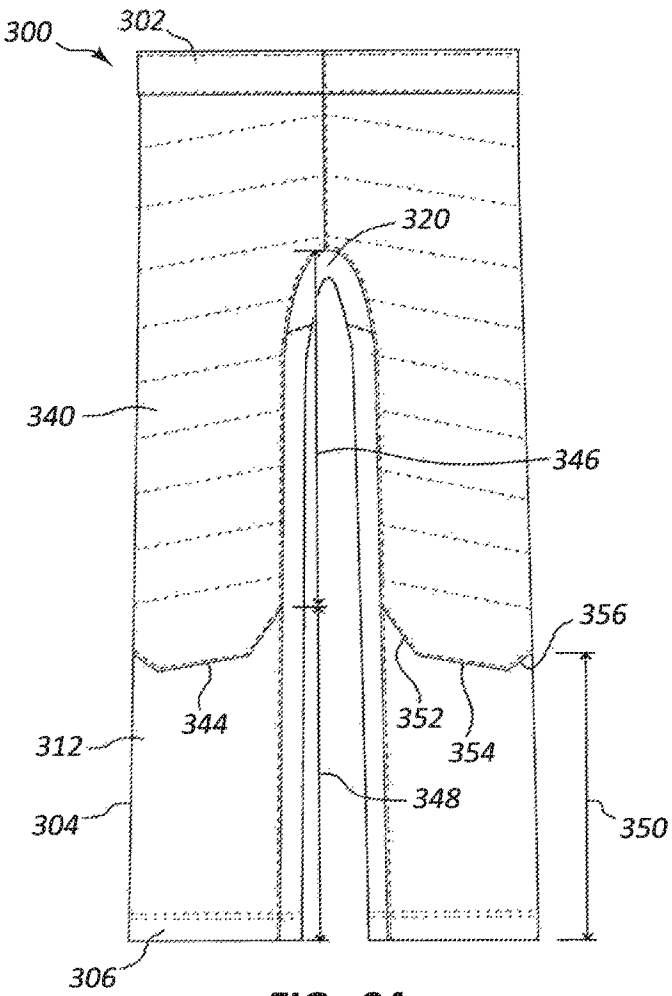
FIG. 9A is a front elevation view of the pants of FIG. 8A showing a body mapping of insulative material according to an embodiment of the disclosure.

FIGS. 9A-9B shows insulative panels positioned on the pants 300 according to an embodiment of the disclosure. The leg 304 may include a front insulative panel 340 and a back insulative panel 342 made from the second material and positioned on an inner surface of the pants 300. The insulative panels 340, 342 may be embodied similarly as the other insulative panels (e.g., insulative panels 144, 146, 148, 150, 204, 224, 226) discussed above.

The front insulative panel 340 may be positioned on an inner surface of the front leg panel 312. The front insulative panel 340 may extend from the waistband 302 to a distal edge 344 positioned near the wearer's knee. The front insulative panel 340 may terminate at or above the wearer's knee in order to not inhibit the flex of the wearer's knee when engaged in activity. In some embodiments, the front insulative panel 340 terminate at a position above the knee of the wearer. For example, the front insulative panel 340 may terminate at a mid-thigh of the wearer.

A proximal inseam distance 346 may be defined between the crotch 320 and the intersection of the anterior inseam 322 and the distal edge 344. In some embodiments, the proximal inseam distance 346 is constant even if the overall size of the pants 300 changes (e.g., 34" waist and 34" inseam). A distal inseam distance 348 may be defined between the hem 306 and the intersection of the anterior inseam 322 and the distal edge 344. In some embodiments, the distal inseam distance 348 may be equal to sixteen and one-half inches. A lateral distance 350 may be defined between the hem 306 and the intersection of the side seam 318 and the distal edge 344. In some embodiments, the lateral distance 350 may be equal to fourteen inches.

The distal edge 344 may include a first edge 352, a second edge 354, and a third edge 356 set at angles with one another. The first edge 352 may intersect the side seam 318. In some embodiments, the first edge 352 may be two inches long. The third edge 356 may interest the anterior inseam 322. In some embodiments, the third edge 356 may be two and one-quarter inches long. The second edge 354 may extend between the first edge 352 and the third edge 356. In some embodiments, the second edge 354 may be four and three-quarters inches long.

The back insulative panel 342 may be positioned on an inner surface of the back leg panel 314. The back insulative panel 342 may extend from the waistband 302 to a distal edge 358 positioned near the wearer's mid-thigh. The back insulative panel 342 may terminate the wearer's mid-thigh in order to not inhibit the flex of the wearer's knee when engaged in activity. In some embodiments, the distal edge 358 of the back insulative panel 342 may be positioned so that the wearer is able to sit or squat without discomfort. In some embodiments, the back insulative panel 342 may terminate at different position along the leg 304.

A proximal inseam distance 360 may be defined between the crotch 320 and the intersection of the posterior inseam 324 and the distal edge 358. In some embodiments, the proximal inseam distance 360 is constant even if the overall size of the pants 300 changes. In some embodiments, the proximal inseam distance 346 of the front insulative panel 340 is greater than the proximal inseam distance 360 of the back insulative panel 342. A distal inseam distance 362 may be defined between the hem 306 and the intersection of the posterior inseam 324 and the distal edge 358. A lateral distance 364 may be defined between the hem 306 and the intersection of the side seam 318 and the distal edge 358. In some embodiments, the distal inseam distance 362 is greater than the lateral distance 364 such that the distal edge 358 is angled, as compared to the hem 306. In some embodiments, the distal inseam distance 362 is one inch greater than the lateral distance 364. In some embodiments, the proximal inseam distance 360 is less than the proximal inseam distance 346.

The pants 300 may also include pockets 370 and belt loops 372. The pockets 370 may be internal pockets or cargo pockets. The pockets may be positioned on the pants 300 according to the comfort of the wearer.

Figure 10B:
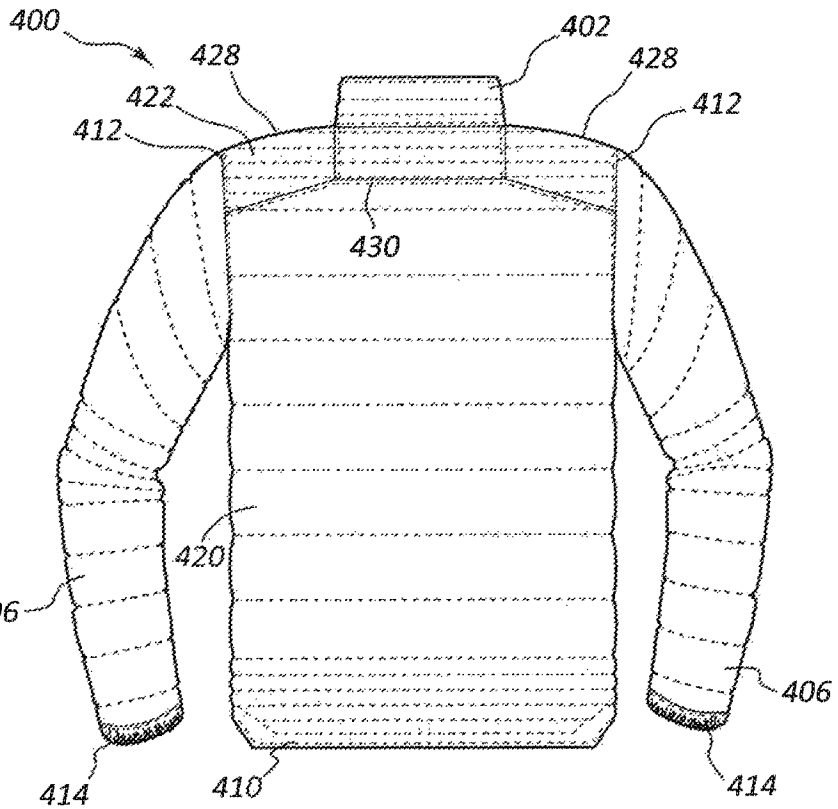
FIG. 10B is a back elevation view of the jacket of FIG. 10A according to an embodiment of the disclosure.
Figure 10A:
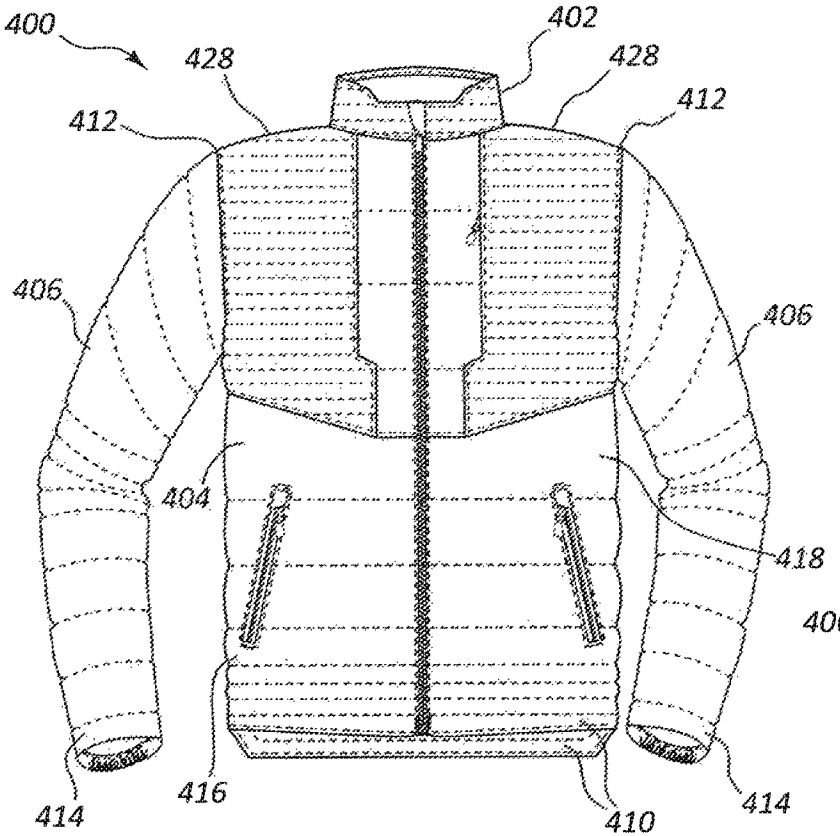
FIG. 10A is a front elevation view of a jacket according to an embodiment of the disclosure.

FIGS. 10A and 10B another jacket 400 according to an embodiment of the disclosure. The jacket 400 includes areas of additional insulation determined by a body mapping.

The jacket 400 includes a collar 402, a vest 404, and sleeves 406. The collar 402, vest 404, and sleeves 406 may be coupled together via one or more seams 408. The vest 404 may extend from the collar 402 to a hem 410. The sleeves 406 may extend from an armscye 412 of the vest 404 to a cuff 414.

The vest 404 may include a first front panel 416, a second front panel 418, a back panel 420, and a yoke panel 422. For ease of description, the features of only the first front panel 416 will be described in this disclose. The second front panel 418 is similarly embodied as the first front panel 416. The first front panel 416 may be coupled to the back panel 420 via a side seam 424 extending from an armpit 426 on the armscye 412 to the hem 410. The first front panel 416 may be coupled to the yoke panel 422 via a shoulder seam 428 positioned at the top of a wearer's shoulder. The back panel 420 is coupled to the yoke panel 422 via a bottom yoke seam 430. The first front panel 416, the back panel 420, and the yoke panel 422 cooperate to form the armscye 412 of the jacket 400. In some embodiments, the side seam 424 may not be visible on the inner liner of the jacket 400.

The jacket 400 may be constructed in a different manner than the jacket 100 described above with reference to FIGS. 1-7. The jacket 400 may include an outer layer 440, an insulative layer 442, and a liner 444. The insulative layer 442 and the liner 444 may be similarly embodied as the insulative layer 254 and the liner 258. For example, the insulative layer 442 may be made of a synthetic insulation, such as a synthetic microfiber thermal insulation sometimes sold under the trademark Primaloft®, and the liner 258 may be made of taffeta. The outer layer 440 may include an outer shell and an inner liner, with insulation positioned therebetween. The outer layer 440 includes insulative material and additional insulative layers 442 may be added according to a body mapping. In some embodiments, the insulative material of the outer layer 440 and the insulative layers 442 are made from the same material.

Figure 11:
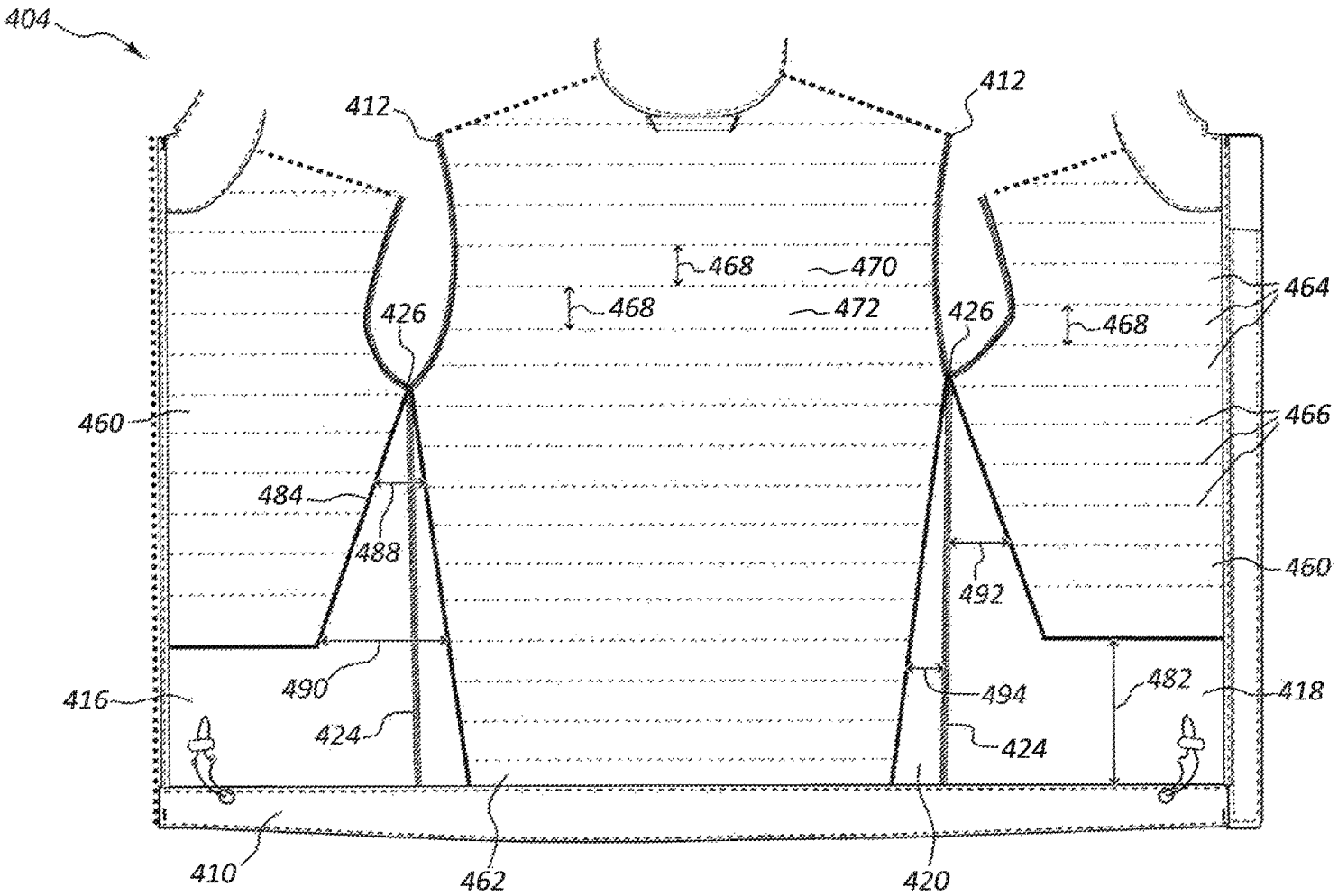
FIG. 11 is an elevation view of a vest of the jacket of FIG. 10A according to an embodiment of the disclosure.

FIG. 11 shows an elevation view of the vest 404 according to an embodiment of the disclosure. In FIG. 4, the vest 404 is flattened to show the construction of the vest 404. The jacket 400 includes a front insulative area 460 and a back insulative area 462. The insulative areas 460, 462 may have baffles 464 formed therein. The baffles 464 may be formed by a number of baffle seams 466. Insulative material, such as the second material 256, may be positioned in each baffle 464 such that the insulative material in one baffle 464 cannot move to another baffle 464. A baffle height 468 is defined by each baffle between two bordering baffle seams 466. The baffle height 468 may vary for each baffle 464. For example, a baffle 470 defines a larger baffle height 468 than the baffle 472. The baffle heights 468 may be adjusted to improve the mobility of the wearer. For example, in areas where the jacket 400 may experience a lot of movement of the wearer, the baffle heights 468 may be smaller (and hence more baffles 464 may be present). In areas of the jacket 400 that do not experience much movement, the baffle heights 468 may be larger.

The front insulative area 460 may extend between the shoulder seam 428 and a bottom edge 480. A bottom span 482 may be defined between the bottom edge 480 and the hem 410. The front insulative area 460 may also include a front lateral edge 484 extending between the armscye 412 and the bottom edge 480. The back insulative area 462 may extend between the shoulder seam 428 and the hem 410 of the vest 404. The back insulative area 462 may include a back lateral edge 486 extending between the armscye 412 and the hem 410. The front lateral edge 484 and the back lateral edge 486 are positioned near the side seam 424.

At a first point along the side seam 424, the front lateral edge 484 and the back lateral edge 486 may be separated by a first span 488. At a second point along the side seam 424, the front lateral edge 484 and the back lateral edge 486 may be separated by a second span 490 different than the first span 488. The second span 490 may define a distance between the lateral edges 484, 486. In some embodiments, the second point may be closer to the hem 410 than the first point and the second span 490 may be larger than the first span 488. In the illustrative example, as the lateral edges 484, 486 get closer to the hem 410 the spans between the lateral edges 484, 486 gets larger.

In addition, a front span 492 may be defined between the side seam 424 and the front lateral edge 484 and a back span 494 may be defined between the side seam 424 and the back lateral edge 486. In such examples, either the first span 488 or the second span 490 may comprise a combination of a front span 492 and a back span 494. In the illustrative embodiment, the distance defined by the front span 492 and the distance defined by the back span 494 of a total span (e.g., spans 488, 490) may not be equal. Meaning, either the distance of the front span 492 may be greater than or less than the distance of the back span 494 defined in a total span. In some embodiments, at any given point along the side seam 424, the front span 492 may be greater than the back span 494.

The spans 488, 490 may vary along the length of the side seam 424. For example, at the armpit 426, the span between the lateral edges 484, 486 may be equal to zero. It should be appreciated that front spans, back spans, and total spans may be defined at any point along the side seam 424.

In some embodiments, each of the insulative areas 460, 462 may include different amounts of insulative material, such as the second material 256. For example, the front insulative area 460 may include less insulative material than the back insulative area 462. In addition, the outer layer 250 may include less insulative material than the back insulative area 462. In some embodiments, the outer layer 440 may include 80 grams of insulative material per square meter. In some embodiments, the front insulative area 460 may include 80 grams of insulative material per square meter. In some embodiments, the back insulative area 462 may include 100 grams of insulative material per square meter. In some embodiments, the front insulative area 460 may include 60 grams of insulative material per square meter. In some embodiments, back insulative area 462 may include 80 grams of insulative material per square meter. In some embodiments, the outer layer 440, the front insulative area 460, and the back insulative area 462 include the same amounts/densities of insulative material.

The collar 402 extends from the vest 404 and is configured to surround a neck of the wearer of the jacket 400. Along an anterior portion, the collar 402 defines a front height. Along a posterior portion, the collar 402 defines a height that is greater than the front height. In some embodiments, the height is one inch greater than the front height.

Figure 12:
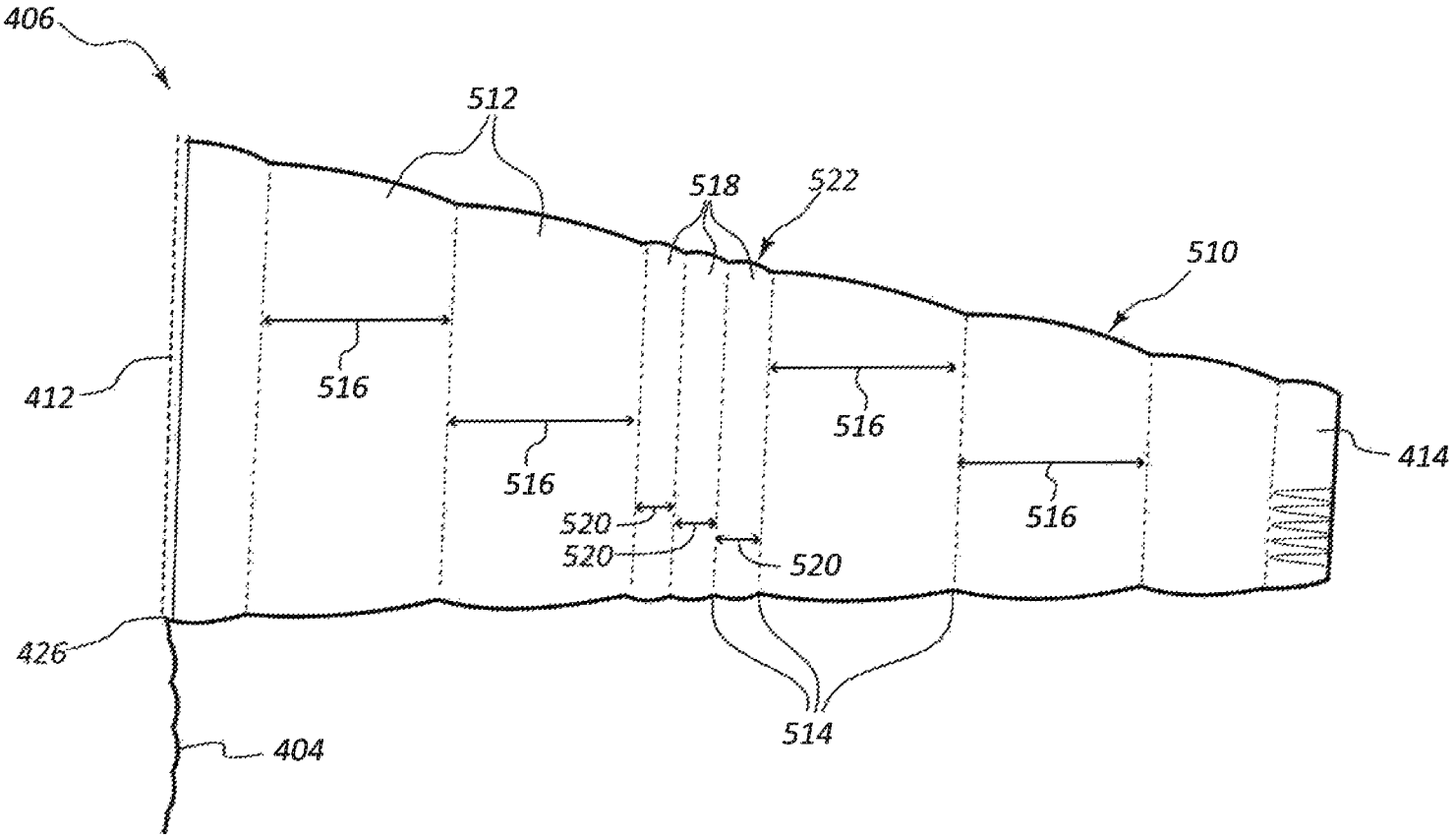
FIG. 12 is an elevation view of a sleeve of the jacket of FIG. 10A according to an embodiment of the disclosure.

FIG. 12 shows an elevation view of the sleeve 406 according to an embodiment of the disclosure. The sleeve 406 extends from an armscye 412 of the vest 404 to the cuff 414. The sleeve 406 includes a sleeve insulative area 510. A set of first sleeve baffles 512 are defined in the sleeve 406 by sleeve baffle seams 514. The set of first sleeve baffles 512 define a first baffle dimension 516. A set of second sleeve baffles 518 are defined in the sleeve 406 by sleeve baffle seams 514. The set of second sleeve baffles 518 define a second baffle dimension 520 that is smaller than the first baffle dimension 516. The set of second sleeve baffles 518 are positioned near the elbow 522 of the sleeve 406. Having smaller baffles near the elbow 522 may increase the mobility of the wearer at the elbow joint. In some embodiments, the first baffle dimension 516 is three and one-half inches. In some embodiments, the second baffle dimension 520 is three-quarters of an inch.

Figure 13B:
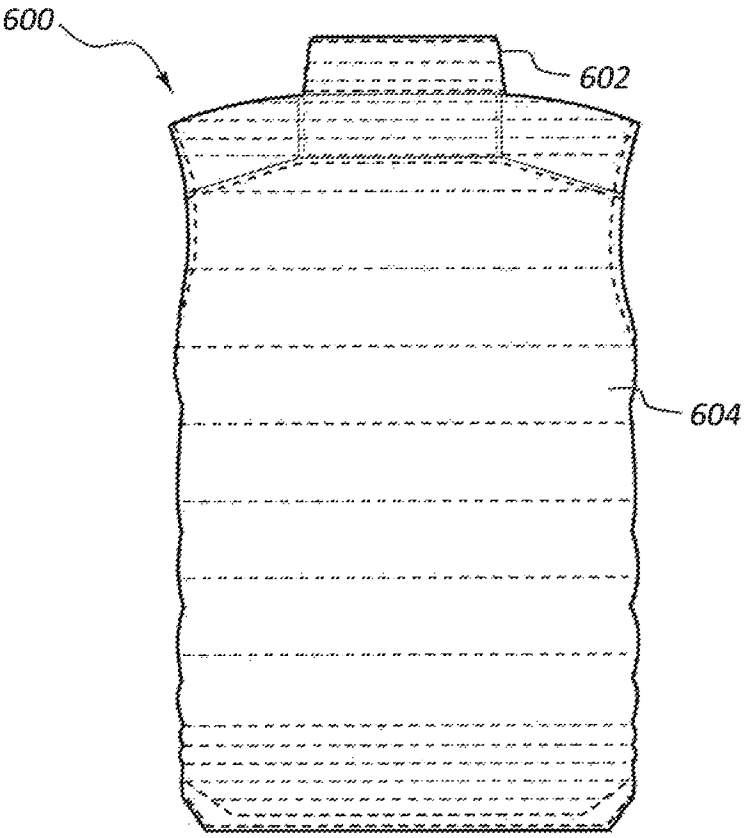
FIG. 13B is a back elevation view of the jacket of FIG. 13A according to an embodiment of the disclosure.
Figure 13A:
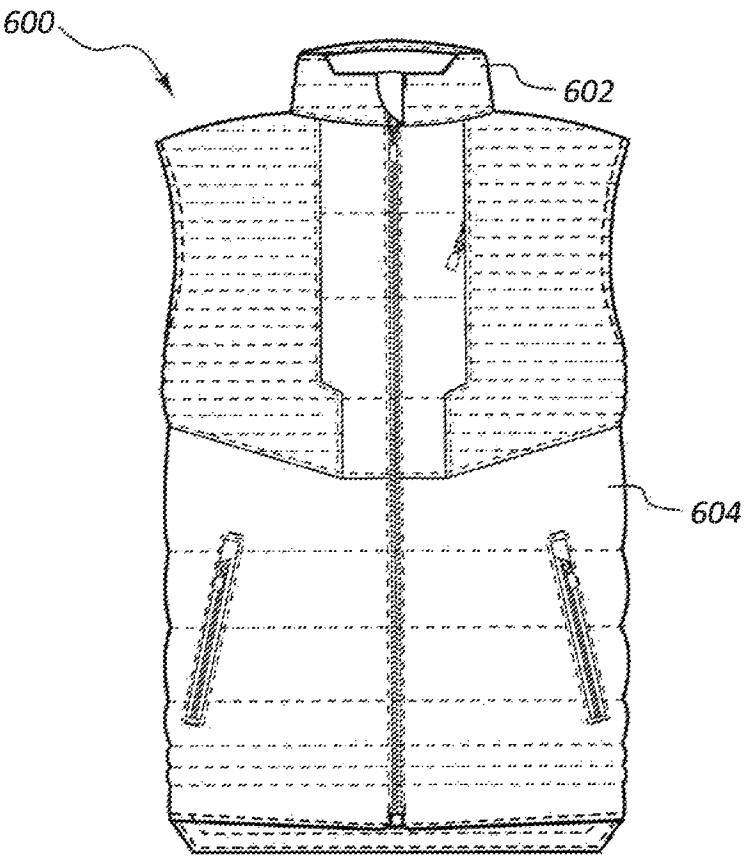
FIG. 13A is a front elevation view of a jacket according to an embodiment of the disclosure.

FIGS. 13A-13B shows a jacket 600 according to an embodiment of the disclosure. The jacket 600 may be similarly embodied as the jacket 400 except that the jacket 400 does not include any sleeves. The jacket 600 includes a collar 602 and a vest 604. The jacket 600 also include additional insulative areas positioned on the jacket according to a body mapping discussed above. Because the jacket 600 is similarly embodied as the jacket 400, a full description of the jacket 600 is not given here.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. A jacket comprising:
a collar;
a vest extending from the collar to a hem and having an anterior side and a posterior side, the vest being made of a first material, the vest including a front vest panel positioned on the anterior side and a back vest panel positioned on the posterior;
a front insulative panel positioned on the front vest panel extending from a first seam to a first edge; and
a back insulative panel positioned on the back vest panel extending from a second seam to a second edge;
wherein the front insulative panel and the back insulative panel are separated by a first span at an armpit of the vest, and the front insulative panel and the back insulative panel are separated by a second span at the first edge, the second span being greater than the first span.

2. The jacket of claim 1, further comprising:
a side seam connecting the front vest panel and the back vest panel, the side seam extending between the armpit of the vest and the hem;
a first front span defined between the front insulative panel and the side seam at the armpit; and
a second front span defined between the front insulative panel and the side seam at the first edge;
wherein the second front span is greater than the first front span.

3. The jacket of claim 2, further comprising:
a first back span defined between the back insulative panel and the side seam at the armpit; and
a second back span defined between the back insulative panel and the side seam at the first edge;
wherein the second back span is greater than the first back span.

4. The jacket of claim 3, further comprising:
a third back span defined between the back insulative panel and the side seam at the second edge;
wherein the third back span is greater than the second back span.

5. The jacket of claim 1, wherein:
the front vest panel defines a front panel length between the collar and the hem;
the front insulative panel defines a front insulation length between the collar and the first edge; and
the front panel length is greater than the front insulation length.

6. The jacket of claim 1, wherein:
a front insulation length is defined between the collar and the first edge;
a back insulation length is defined between the collar and the second edge; and the back insulation length is greater than the front insulation length.

7. The jacket of claim 6, wherein:

the back vest panel defines a back panel length; and the back panel length is greater than the back insulation length.

8. The jacket of claim 1, further comprising:

a first back panel span defined between the second edge and the hem at a first end of the second edge; and a second back panel span defined between the second edge and the hem at a mid-point of the second edge between the first end and a second end of the second edge;

wherein the second back panel span is greater than the first back panel span.

9. The jacket of claim 1, wherein the back vest panel includes a yoke and the back insulative panel is positioned at least partially on the yoke.

10. The jacket of claim 1, wherein a front height positioned at the anterior-side of the collar is less than a height of the collar.

11. The jacket of claim 1, further comprising:

a hood extending from the collar to a brim, the hood being made of the first material; and a hood insulative panel extending from the collar to the brim, the hood insulative panel defining an insulation width that is less than a hood width.

12. The jacket of claim 1, further comprising:

a sleeve extending from an armscye of the vest to a cuff, the sleeve being made of the first material;

a first sleeve insulative panel positioned on the sleeve and extending from the armscye to a first elbow edge; and a second sleeve insulative panel positioned on the sleeve and extending from a second elbow edge to the cuff.

13. The jacket of claim 12, wherein the first elbow edge and the second elbow edge are separated by a sleeve distance.

14. The jacket of claim 12, wherein the first sleeve insulative panel and the second sleeve insulative panel are positioned opposite a sleeve seam of the sleeve.

15. The jacket of claim 12, wherein both the first sleeve insulative panel and the second sleeve insulative panel define widths that are less than a diameter of the sleeve.

16. The jacket of claim 1, wherein the front insulative panel and the back insulative panel are made of a second material different from the first material.

17. The jacket of claim 16, wherein the first material is fleece and the second material is a synthetic microfiber thermal insulation.

18. The jacket of claim 17, wherein the synthetic microfiber thermal insulation is Primaloft.

19. The jacket of claim 16, wherein the back insulative panel includes more of the second material per square meter than the front insulative panel.

20. The jacket of claim 19, wherein the back insulative panel comprises 80 grams per square meter of the second material and the front insulative panel comprises 60 grams per square meter of the second material.

21. The jacket of claim 1, wherein the front insulative panel and the back insulative panel are positioned on an inner surface of the vest such that the front insulative panel and the back insulative panel are facing a body of a wearer of the jacket.

22. The jacket of claim 1, further comprising:

a front liner coupled to the front vest panel of the vest, the front liner being made of a third material different than the first material; and a back liner coupled to the back vest panel of the vest, the back liner being made of the third material;

wherein the front insulative panel is positioned between the front liner and the vest and the back insulative panel is positioned between the back liner and the vest.

23. A pant comprising:

a waistband;

a first leg extending from the waistband to a hem defining a first length, the first leg being made of a first material and having an anterior side and a posterior side;

a front insulative panel positioned on the anterior side of the first leg, the front insulative panel extending from the waistband and terminating before the hem, the front insulative panel defining a second length, the second length being less than the first length; and a back insulative panel positioned on a posterior side of the first leg, the back insulative panel extending from the waistband and terminating before the hem, the back insulative panel defining a third length, the third length being less than the second length.

24. The pant of claim 23, wherein the first leg further comprises an interior panel extending from a crotch of the first leg to the hem, the interior panel being made of the first material.

25. The pant of claim 23, wherein the front insulative panel and the back insulative panel are positioned on an inner surface of the first leg such that the front insulative panel and the back insulative panel are facing a body of a wearer of the pant.

26. The pant of claim 23, wherein:

the front insulative panel defines a first inseam length between a crotch an end of the front insulative panel and the back insulative panel defines a second inseam length between the crotch and an end of the back insulative panel; and the second inseam length being less than the first inseam length.

27. The pant of claim 26, wherein as a size of the pant changes, the first inseam length and the second inseam length do not change.

28. The pant of claim 23, wherein the front insulative panel and the back insulative panel are made of a second material different from the first material.

29. The pant of claim 28, wherein the first material is fleece and the second material is a synthetic microfiber thermal insulation.

30. The pant of claim 29, wherein the synthetic microfiber thermal insulation is Primaloft.

31. The pant of claim 23, further comprising:

a front liner coupled to the anterior-side of the first leg, the front liner being made of a third material different than the first material; and a back liner coupled to the posterior-side of the first leg, the back liner being made of the third material;

wherein the front insulative panel is positioned between the front liner and the first leg and the back insulative panel is positioned between the back liner and the first leg.

32. The pant of claim 23, wherein the front insulation panel terminates at a knee of a wearer of the pant.

33. The pant of claim 23, wherein the back insulative panel terminates at a mid-thigh of a wearer of the pant.

* * * * *